US005626232A

United States Patent [19]

Volkert et al.

[11] Patent Number: 5,626,232

[45] Date of Patent: May 6, 1997

[54] ITEM HAVING PIVOTING THREE-DIMENSIONAL DISPLAY

[75] Inventors: Carolyn K. Volkert, Northfield, Ill.; Andrew M. Volkert, Cardiff by the Sea, Calif.

[73] Assignee: Volkert, Inc., Northfield, Ill.

[21] Appl. No.: 440,717

[22] Filed: May 15, 1995

[51] Int. Cl.[6] ..... B65D 5/52

[52] U.S. Cl. ..... 206/768; 40/312; 206/459.5

[58] Field of Search ..... 206/767, 768, 206/831, 459.5; 40/312

[56] References Cited

U.S. PATENT DOCUMENTS

| | | | |
|---|---|---|---|
| 2,136,797 | 11/1938 | Lee | 206/768 |
| 2,332,078 | 10/1943 | Hirschhorn . | |
| 2,884,738 | 5/1959 | Lohnes et al. . | |
| 2,914,236 | 11/1959 | Shapiro | 206/767 |
| 3,235,988 | 2/1966 | Paige . | |
| 3,674,133 | 7/1972 | Locke | 206/767 |
| 4,212,231 | 7/1980 | Penick et al. . | |
| 4,627,640 | 12/1986 | Markovics . | |
| 4,867,480 | 9/1989 | Volkert . | |
| 5,022,681 | 6/1991 | Penick . | |
| 5,377,821 | 1/1995 | Fierek | 206/767 X |

*Primary Examiner*—Bryon P. Gehman

*Attorney, Agent, or Firm*—Fitch, Even, Tabin & Flannery

[57] ABSTRACT

Sheet material items are fabricated which have an intermediate structure in the form of one or more sheets sandwiched between front and rear covers. One such intermediate panel functions as a facade panel behind which a display panel is located. When the covers are opened, the facade panel forms the front of a box-like structure while the display panel emerges into an attention-attracting orientation from an at least a partially hidden position behind the facade panel. Actuation is achieved through a subpanel that is hinged to the display panel along an angularly oriented line of weakness, causing the display panel to move into its exposed position by sliding along an edge or interior surface of one of the major walls of the box-like structure. Alternatively, in another embodiment, an intermediate structure having two halves is affixed via subpanels in each half to the interior surface of both cover panels at locations near the hinge line, and display panels connected to such subpanels by hinge lines oriented at angles of about 45° to the cover hinge line assume a three-dimensional orientation as a result of strategically located interconnections between the halves.

20 Claims, 4 Drawing Sheets

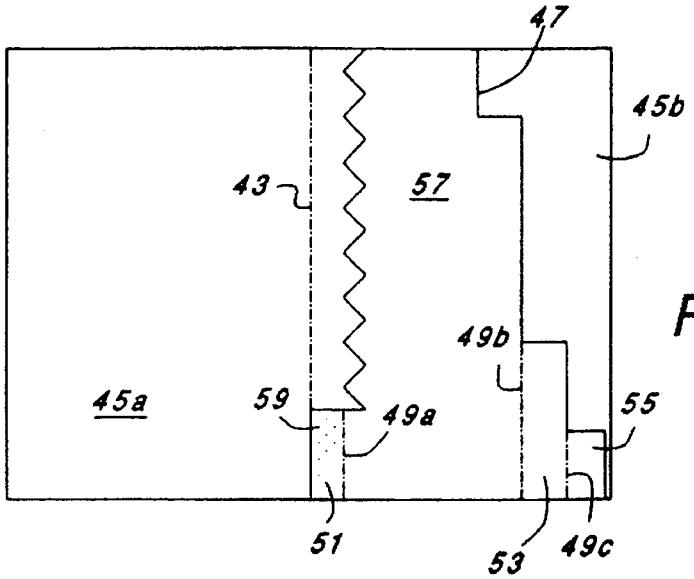
FIG. 5
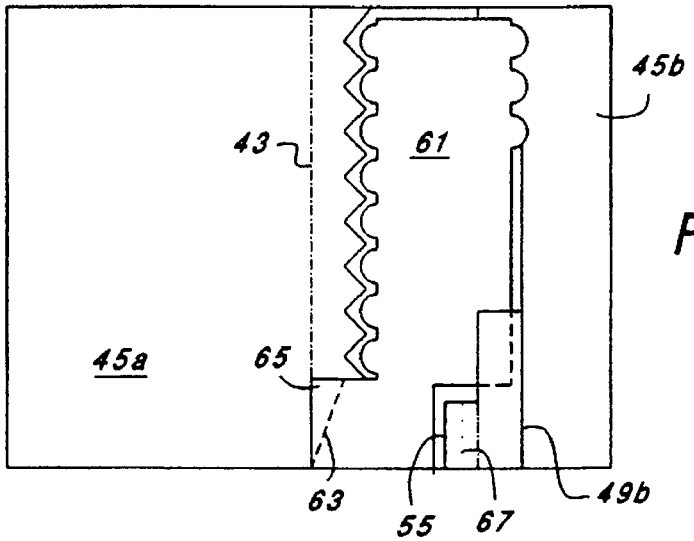
FIG. 6
FIG. 7
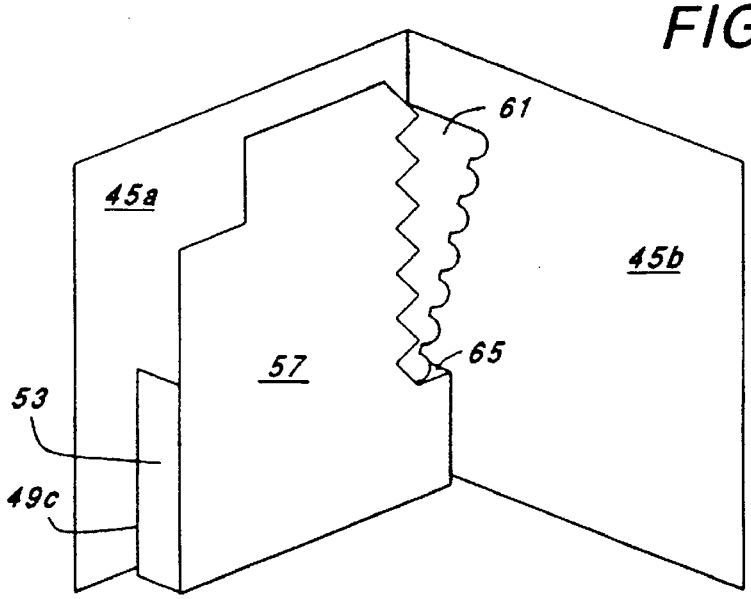

ITEM HAVING PIVOTING THREE-DIMENSIONAL DISPLAY

This invention relates to printed sheet material pieces and more particularly to dimensional and specialty paper products of the general character wherein an intermediate structure is provided between a pair of cover panels which, upon opening thereof, moves away from the planes of the cover panels to assume a three-dimensional configuration which may be accompanied by other ancillary motion.

BACKGROUND OF THE INVENTION

Advertising handouts, inserts, direct mail pieces and the like are being used with greater and greater frequency to promote particular products and/or services. Items of this general character are frequently used together with an accompanying text in order to illustrate a particular theme or simply to attract attention. Likewise, structures of this type have a significant attraction for greeting cards or the like wherein novel pop-up structures are continually being sought. Accordingly, commercially practical items of this general type which incorporate attention-attracting features remain in demand, and such items which are capable of efficient mass production or at least machine production (as opposed to hand production) are considered to be particularly sought after.

SUMMARY OF THE INVENTION

The invention provides sheet material items wherein a pair of front and rear outside cover panels sandwich therebetween an intermediate sheet material structure; upon opening by pivoting one cover panel, a three-dimensional effect is achieved. In one embodiment, the structure includes an associated display panel which pivots from an at least partially hidden orientation behind a facade panel, which may be part of a box-like structure, to an attention-attracting exterior orientation. The display panel can be either completely or partially hidden behind the front facade panel, which can be one major wall of a parallelogram-like, box-like structure with either the rear or front cover panel constituting a second major wall of the parallelogram-like structure that is parallel to the facade panel. The display panel has a hinged subpanel which is usually affixed to the interior surface of one of the parallelogram minor side walls, and this subpanel is interconnected with the main portion of the display panel along a line oriented at an angle of between about 15° and about 70° to the hinge line about which opening occurs. During opening, the subpanel moves with the respective minor side wall of the parallelogram structure to which it is affixed; however, the display panel cannot rotate with it because it is blocked by either the adjacent cover panel or the facade panel. Thus, as the subpanel swings through about 180° when the two cover panels are opened to an essentially flat condition, the angularly hinged display panel is caused to move to an exposed location, generally sliding along the interior surface of one major wall of the parallelogram-like structure. In another embodiment, an intermediate structure having two halves is affixed via one subpanel in each half, respectively, to the interior surfaces of both cover panels at locations near the hinge line, and display panels connected to such subpanel at an angle of about 45° to the hinge line assume a three-dimensional orientation as a result of interconnections between the halves.

BRIEF DESCRIPTION OF THE DRAWINGS

FIG. 5 is a view generally similar to FIG. 2 showing an alternative embodiment of a partially assembled sheet material item embodying various features of the invention.

FIG. 6 is a view similar to FIG. 5 showing the item in partially assembled condition with another piece added to the two pieces in FIG. 5.

FIG. 7 is a perspective view showing the fully assembled item of FIG. 5 in an open orientation generally similar to FIG. 3.

DETAILED DESCRIPTION OF THE PREFERRED EMBODIMENTS

Figure 1:
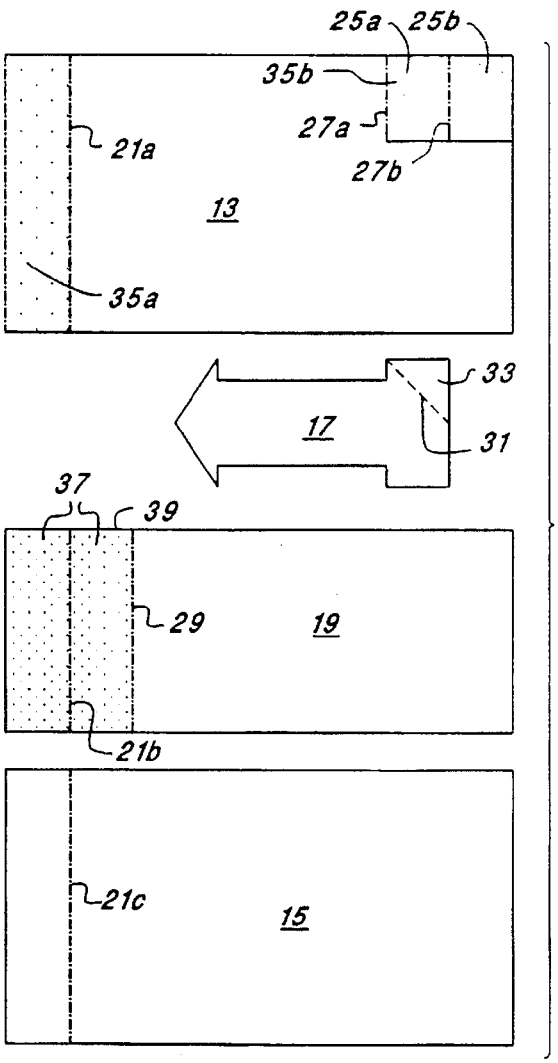
FIG. 1 is a composite view of 4 sheet material pieces that together form a sheet material item embodying various features of the present invention.
Figure 3:
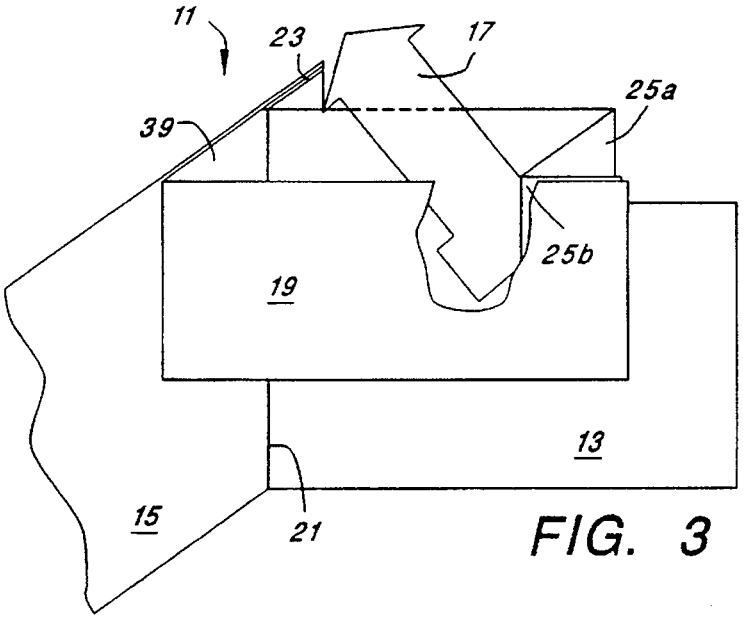
FIG. 3 is an enlarged prospective view showing the fully assembled sheet material item in an open position wherein the display panel has moved to an exterior attention-attracting location.
Figure 8:
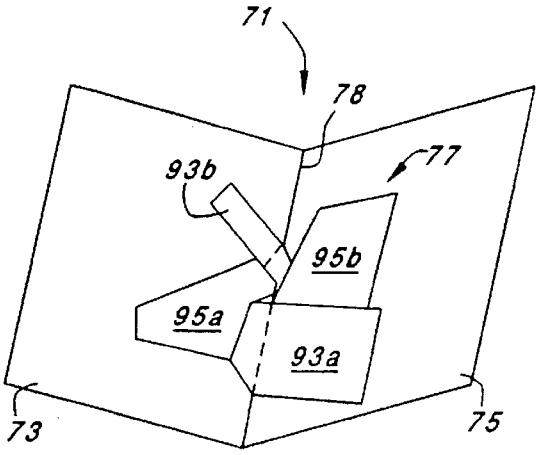
FIG. 8 is a perspective view of another alternative embodiment of a sheet material item, in fully assembled condition, embodying various features of the invention.

Illustrated in FIG. 1 are 4 separate sheet material pieces that, when assembled, form a sheet material item 11 depicted in FIG. 3 embodying various features of the present invention. More specifically, they include a rear cover sheet 13, a front cover sheet 15 and a pair of intermediate sheets 17 and 19 which become sandwiched therebetween. The smaller intermediate sheet 17 functions as a display panel having a section shaped as an arrow, and the larger intermediate sheet 19 serves as a box-forming or facade panel behind which the display panel is hidden. The sheet material is preferably suitable paper or paperboard material, glossy or matte finish as desired; however, it could alternatively be any suitable fabricated sheet material, e.g. thermoplastic materials.

The rear cover 13, the intermediate sheet 19 and the front cover 15 are provided with aligned lines of weakness, respectively 21*a*, 21*b* and 21*c*, spaced a desired distance from the left-hand edge of each sheet to create a false backbone 23 in the finished product. The rear cover sheet 13 is also die-cut to create hinged minor panels 25*a* and 25*b* in the upper right-hand corner with an associated pair of lines of weakness 27*a* and 27*b*. The intermediate sheet 19 is also formed with a second line of weakness 29 that is parallel to the line 21*b*, defining one minor wall 39 of the box-like structure, and also defining the left-hand edge of a panel that forms the front facade panel of the box-like tubular structure. One further line of weakness 31 is formed in the smaller intermediate sheet 17 at an angle between about 15° and about 70° and preferably between about 30° and about 45° to the vertical in FIG. 1, i.e. to a line parallel to the hinge line that is created by the lines of weakness 21*a, b* and *c;* this line of weakness creates a generally triangular subpanel 33 which is hinged to the display panel 17. The lines of weakness can be formed by impressing, scoring or slightly perforating the sheet material to create thin, longitudinal regions along which bending will preferentially occur. Alternatively, as known in this art, certain of the lines of weakness may be omitted to simply rely upon the natural resiliency of the paper or the like to effect appropriate bending at the approximate desired location, e.g. adjacent a region of adhesive. However, lines of weakness are preferred as they create a neater appearance in the final product.

Patterns of adhesive 35*a* and 35*b* are preferably provided upon the interior surface of the rear cover 13 using any suitable adhesive; for example, hot melt or solvent-based adhesive or generally any permanent-type adhesive can be used having a bond strength that is generally higher than the tear strength of the fibers, assuming a paperboard sheet material is used. Other adhesive arrangements as are well known in the art, including heat, ultrasonic or RF-activated or even micro-encapsulated adhesives can alternatively be used. If desired, co-adhesive patterns of a material that will adhere only to itself can be applied to the appropriate locations upon facing surfaces, as is also known in this art. Likewise, instead of applying the adhesive to the interior surface of the rear cover 13, the adhesive could instead be applied to the facing locations on the other sheet material pieces that will be joined thereto. One adhesive pattern 35*a* covers the false backbone region to the left of the line of weakness 21*a*, and the other adhesive pattern 35*b* covers the entire minor attachment panel 25*b* and an upper region of the minor side panel 25*a* where the triangular subpanel 33 of the display panel will be secured thereto.

Figure 2:
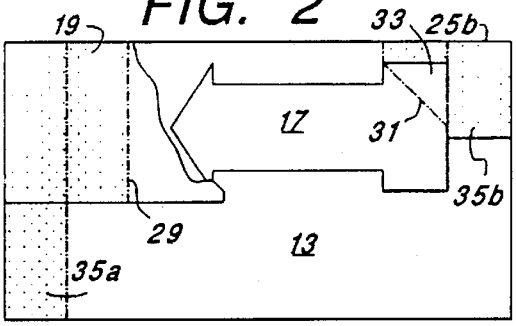
FIG. 2 is a front view of three of the pieces from FIG. 1 shown in assembled condition.

As the next step in the fabrication process, the smaller intermediate sheet which includes the display panel 17 is placed atop the rear cover 13 so that the triangular subpanel 33 is secured to the minor side panel 25*a* by a portion of the adhesive pattern 35*b*. It is located slightly below the upper edge of the rear cover sheet 13 for a reason to be explained hereinafter. Next, the larger intermediate panel 19 is placed atop the two sheets 13 and 17, as partially shown in FIG. 2, so as to completely cover the display panel 17. The left-hand edge region of the intermediate panel 19 in the area of the false backbone 23 becomes secured to the rear cover panel 13 by the adhesive pattern 35*a*, and the right-hand edge region of the facade panel 19 becomes affixed to the attachment panel 25*b* by the adhesive pattern 35*b*. The upper surface of the intermediate panel 19 is itself provided with an adhesive pattern 37 covering the entire region left of the line of weakness 29, which constitutes what becomes a portion of the false backbone 23 and the panel 39 that becomes a minor side wall of the generally box-like structure that is formed in the ultimate product. The adhesive pattern 37 can be applied either prior to assembly, as indicated in FIG. 1, or after it has been superimposed upon the rear cover.

Finally, the top or front cover 15 is superimposed upon the 3-sheet subassembly, aligning the line of weakness 21*c* with the lines of weakness 21*b* and 21*a*. The adhesive patterns 35*a* and 37 complete the formation of the false backbone 23, and the adhesive on the side panel 39 causes it to be secured to the interior surface of the front cover 15 completing the assembly of the sheet material item 11. At this time, the edges can be trimmed to provide a sharp rectangular boundary for the item, as is well known in this art, and for this reason, the display panel 17 was located slightly below the upper edge of the rear cover 13 to permit this trimming which eliminates any adhesive connection between the minor side panel 25*a* and the facade panel 19.

Alternatively, the illustrated arrangement can easily be adapted to more efficient machine assembly simply by forming the smaller intermediate sheet 17 and the rear cover 13 out of the same sheet material and forming the front cover 15 and the larger intermediate sheet 19 out of the same sheet material. After the appropriate adhesive patterns 35*b* and 37 are applied, the die-cut display panel sheet 17 could then be folded down into the relative position shown in FIG. 2 from an original location above the rear cover, and the larger intermediate sheet 19 could be folded downward onto the interior surface of the front cover 15. Then after the two subassemblies are united by the adhesive pattern 35*a* applied in the region of the backbone and the adhesive on the panel 25*b*, trimming would take place, as described above which would sever the front cover 15 and the intermediate sheet 19 along the upper edge and form an assembly substantially the same as that shown in FIG. 3.

Figure 4:
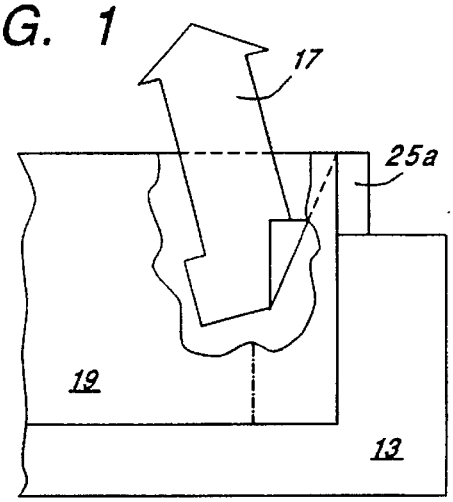
FIG. 4 is a fragmentary front view, with portions broken away, of the item of FIG. 3 in full open orientation.

Opening of the sheet material item 11 as shown in FIG. 3, so that the front and rear covers 15 and 13 pivot or swing apart along the line of weakness 21, causes a parallelogram-like structure to appear with the facade panel 19 forming a major front wall and the panels 39 and 25*a* forming the two minor side walls. The major rear wall of the parallelogram is provided by the rear cover 13. The opening of the parallelogram is actuated by the movement of the side panel 39, which is secured by the adhesive 37 to the interior surface of the front cover panel 15, and therefore moves away from the rear cover 13 pulling the hinged facade panel 19 with it. Because the right-hand edge region of the undersurface of the facade panel 19 is secured by adhesive 35*b* to the attachment panel 25*b* that is cut from the rear cover 13, movement of the right-hand edge of the facade panel 19 is thus guided by the swinging of the panel 25*a* about the line of weakness 27*a*, which panel forms the right-hand minor side wall of the parallelogram. The initial movement of the side panel 25*a* from the plane of the rear cover 13 to an orientation generally perpendicular thereto, as shown in FIG. 3, carries the triangular subpanel 33 with it and causes folding of the smaller intermediate sheet to occur along the line of weakness 31 because this display panel is blocked from swinging by the presence of the rear cover 13. As this movement and folding along the line 31 occur, the display panel 17, which in this embodiment is the arrow-like figure, slides upwardly along the interior surface of the rear cover, emerging above the upper edge of the facade panel 19 as shown in FIG. 3. When the opening of the two cover sheets has proceeded even further to the full open position shown in FIG. 4, the side panel 25*a* has rotated 180° and is now lying flush atop the adjacent region of the rear cover 13. At the same time, the triangular subpanel 33 has been folded onto the display panel 17, and much of the arrow-like portion of the display panel has emerged from behind the facade panel 19 and is pointing upward in attention-attracting orientation.

Illustrated in FIGS. 5, 6 and 7 is an alternative embodiment of a sheet material item wherein a display panel, which is partially obscured behind a facade panel, emerges further therefrom upon the opening of a pair of hinged cover panels. Shown in FIG. 5 is a single sheet of sheet material of rectangular outline which is bisected by a vertical line of weakness 43 to provide what are termed a front cover panel 45*a* and a rear cover panel 45*b*. However, this terminology is merely used for convenience of description, and it should be understood that, depending upon the printing and upon the effect desired, either of the cover panels could be considered to be the front.

Located in its assembled position on the rear cover panel 45*b* is a first intermediate sheet 47 which is die-cut and formed with 3 parallel lines of weakness 49*a* , 49*b* and 49*c*. The line of weakness 49*a* defines a first minor side panel 51, and the lines of weakness 49*b* and *c* form two interconnected minor panels, i.e. a second side wall panel 53 and an attachment panel 55, leaving the major portion of the intermediate sheet to serve as a facade panel 57. The first panel 51 serves as the right side wall of the ultimate box-like structure that is formed, and it is secured in the location shown in FIG. 5 by adhesive (not shown) that affixes its undersurface to the interior surface of the rear cover panel 45*b* adjacent the hinge line 43, which is the only connection between the intermediate sheets and the rear cover panel.

A triangular adhesive pattern 59 is provided on the upper surface of the side panel 51, as illustrated, or it is provided alternatively in the corresponding location on the undersurface of a second intermediate sheet 61 which primarily constitutes the display panel, as shown in FIG. 6. It has formed therein a line of weakness 63 which creates a triangular subpanel 65. Superimposition of the second intermediate sheet 61 atop the first intermediate sheet 47, as indicated in FIG. 6, secures the triangular subpanel 65 to the facing surface of the side panel 51 by the adhesive pattern 59. Once the display panel 61 is secured in position, the minor panels 53 and 55 are folded thereover along the line of weakness 49*b* as shown in FIG. 6, and an adhesive pattern 67 is applied to the now upper surface of the attachment panel 55. To complete the assembly, the front cover panel 45*a* is folded along the line of weakness 43 onto the rear cover panel 45*b*, sandwiching the two intermediate sheets therebetween and effecting joinder of the attachment panel 55 to the interior surface of the front cover panel 45*a* by the adhesive pattern 67.

Thereafter, opening of the folded cover panels 45*a* and 45*b*, as shown in FIG. 7, causes the first intermediate sheet 47 to form a generally box-like structure with the facade panel 57 prominently in front. The minor panels 53 and 51 which are of equal width constitute the minor side walls, and the cover 45*a* constitutes the major rear wall of the box-like structure. This structure, which is generally that of a parallelogram in a cross section, is actuated to move into the open position as a result of the panel 51 being secured to the interior surface of the rear cover 45*b* which pulls the facade panel 57 to the right, as seen in FIG. 7, causing pivoting to occur about the line of weakness 49*c* between the attachment subpanel 55 that is secured to the interior surface of the front cover 45*a* and the left-hand side wall minor panel 53.

Because the triangular subpanel 65 is affixed to the interior surface of the minor right-hand side panel 51 within the box-like structure, it moves with it and causes folding to occur along the angular line of weakness 63 which is formed at an angle of about 30° to the hinge line 43 in the cover. Because the display panel 61 cannot swing along with the side panel 51 that is affixed to the rear cover 45*b*, folding occurs along the line 63, and the display panel 61 slides against the interior surface of the facade panel 57 moving to the right and emerging further from its partially hidden orientation at the right-hand side of the facade panel in attention-attracting orientation as shown in FIG. 7. As the cover panels continue to pivot further apart, the display panel 61 swings still further into view.

Figure 9:
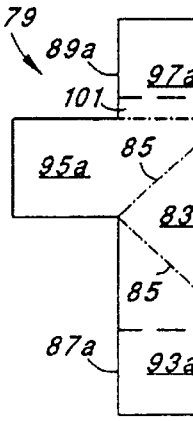
FIGS. 9 and 10 are plan views of left-hand and right-hand sheet material pieces that are used in constructing the intermediate three-dimensional structure that forms a part of the item of FIG. 8.
Figure 10:
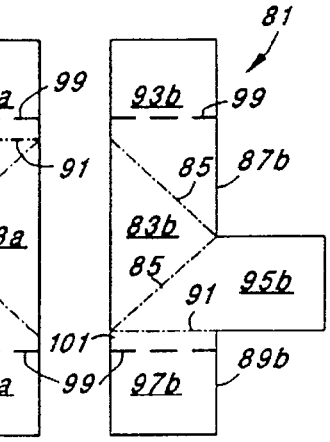

Illustrated in FIGS. 8–14 is another alternative embodiment incorporating particular features of the invention in the form of a sheet material item 71 which upon opening of a pair of front and rear cover panels 73, 75 creates a generally rosette-like intermediate structure 77. As best seen in FIGS. 9 and 10, the intermediate structure is formed from a pair of complementary halves and is affixed via subpanels in each half to the interior surface of both cover panels at locations near a central hinge line 78, and display panels connected to such subpanels at angles of about 45° to the hinge line 78 assume a three-dimensional orientation as a result of interconnections between the halves. More specifically, the intermediate structure includes a left-hand half 79 and a right-hand half 81 which can be of identical structure, which are arranged as shown in FIGS. 9 and 10 to lie in complementary relation to each other. Because the structures are preferably identical, the individual portions thereof are described using the same reference numerals with the suffixes a and b for the left-hand and the right-hand halves, respectively. Generally, each of the halves is of a single-arm cruciform structure, i.e. from which one horizontal arm has been omitted.

Each half 79, 81 terminates in three leaf members, the end portions of which are illustrated as being substantially square; however, they could be of any desired rectangular or irregular shape as the overall halves 79, 81 are preferably die-cut from sheet material. More specifically, each half includes a central, generally triangular subpanel or section 83, which is preferably a right triangle and most preferably an isosceles triangle. The generally triangular section 83 is formed by a pair of hinge lines 85 which in the illustrated embodiment are of equal length and which are preferably aligned at 90° to each other, although this angle might be varied by about ±15°. The hinge lines can be formed as lines of weakness in any suitable manner as described hereinbefore.

Each of the halves includes a first straight leaf structure 87 and a second bifurcated leaf structure 89, with each of the leaf structures being attached to the triangular section 83 via one of the hinge lines 85. Moreover, each of the bifurcated leaf structures includes a hinge line 91 which extends from a vertex of the triangular section 83 at an angle of 45° from the adjacent side of the triangle and which is thus perpendicular to the hypotenuse of the triangular section. The shape of the halves is such as to provide one leaf member 93 at the end of the straight leaf structure 87 and a pair of leaf members 95, 97 at the ends of the bifurcated leaf structure. If desired, lines of perforation 99 can be provided in the halves so as to render the leaf members 93 and 97 easily detachable from the ultimate rosette structure 77. Although not shown, additional lines of perforation could be provided in the bifurcated sections 89 so as to also render the leaf members 95 detachable.

Figure 11:
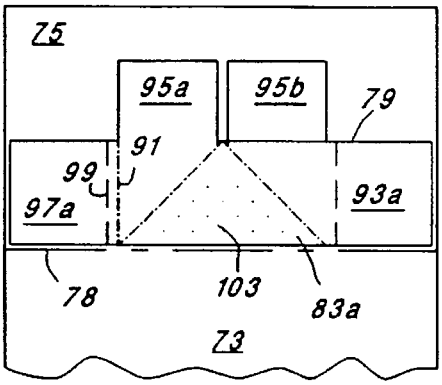
FIG. 11 is a plan view showing the two sheet material pieces of FIGS. 9 and 10 superimposed upon each other and upon the upper panel of a two-panel basepiece.

As best seen in FIGS. 9, 10 and 11, the lines of perforation 99 in the bifurcated structures 89 are spaced distally from the lines of weakness 91 to provide an attachment region 101 therebetween to which a line of adhesive is applied so as to create two such regions of attachment between the individual complementary halves 79 and 81 when they are superimposed upon each other, as depicted in FIG. 11. The adhesive attachment between the two halves 79, 81 can take place either prior to the placement of the half 81 in its desired location on the rear cover 75, or after the right-hand half 81 has been affixed to the interior surface of the rear cover 75. A suitable adhesive pattern 103 is applied to the central triangular region, or applied to the facing region of the rear cover, or both to effect such attachment. Thus, as shown in FIG. 11, the two united halves form a flat intermediate structure which is located with the hypotenuse of the triangular section 83 lying generally adjacent the straight hinge line 78 which joins the two cover panels. Then, with the adhesive pattern 103 either applied to the triangular section 83*a* of the left-hand half 79 or to the corresponding location on the front cover 73, folding takes place about the hinge line 78 to superimpose the covers upon each other and sandwich the intermediate structure 77 therebetween, creating the affixation of the triangular central panel 83 of each of the halves respectively to the interior surface of one of the covers.

Figure 12:
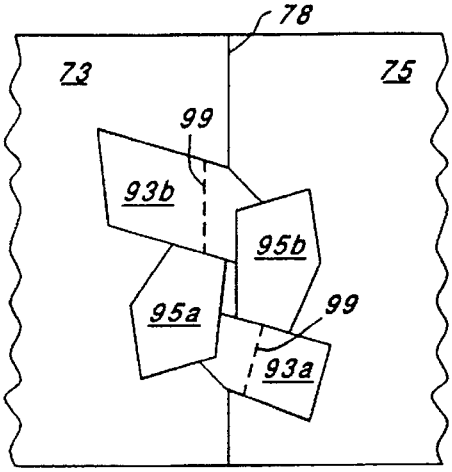
FIG. 12 is a front view looking directly at the assembled sheet material item of FIG. 8 in a partially unfolded condition.
Figure 13:
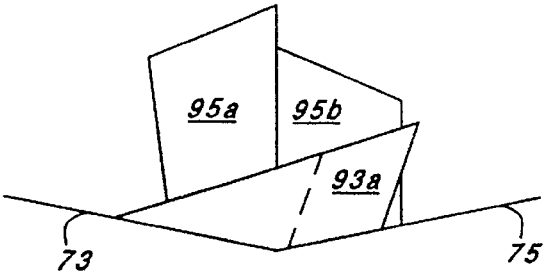
FIG. 13 is a side view looking at the sheet material item as shown in FIG. 12.
Figure 14:
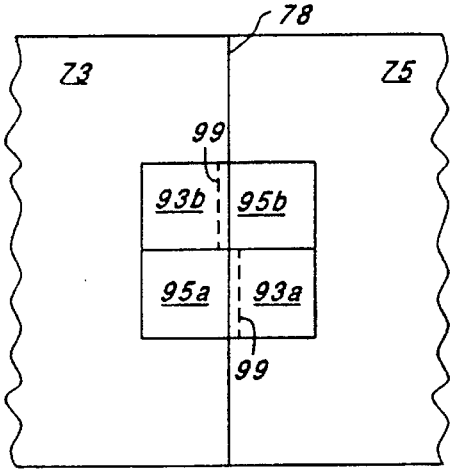
FIG. 14 is a view similar to FIG. 12 showing the completely unfolded item.

When the cover panels 73 and 75 are then opened, the intermediate structure automatically assumes the attractive three-dimensional rosette-like configuration depicted in FIGS. 8 and 12–14. More specifically, the affixation created by the adhesive patterns 103 causes the triangular sections 83 to move away from each other along with the front and rear covers. However, because of the two regions of attachment between the halves along the narrow bands 101, in flanking relation to the triangular central sections 83, these two regions must remain generally in a plane which includes the hinge line 78 between the covers and which generally bisects the angle between the two cover panels, as best seen in FIG. 13. As a result, as the cover panels 73 and 75 spread apart, a complex folding operation occurs, causing the four leaf structures to protrude in four entirely different directions, in generally rosette-style, which also somewhat resembles the blades on a pinwheel.

More specifically, each of the leaf structures is hinged along one of the hinge lines 85 at an angle of 45° to the central hinge line 78, which hinge lines are respectively provided by the four sides of the two isosceles triangles 83. As seen in FIG. 12, the leaf members 95, which are provided by the bifurcated sections, reside generally centrally in the unfolding three-dimensional structure, and slide generally along an edge of the opposite leaf member (FIG. 13) in the opening movement. The composite leaf members that are formed by the juxtaposed leaves 93 and 97 are located in the two upper and lower positions during the initial stages of unfolding. However, in the fully-open position shown in FIG. 14, each of the leaf members essentially occupies a quadrant, which by reference to the points on a compass oriented to FIG. 14 would be the northeast, southeast, southwest and northwest quadrants. As can thus be seen, this provides an extremely attractive display which certainly attracts the attention of the recipient who is opening the two covers. Thus, it is useful not only in decorative greeting cards or the like, but it can be employed as a very useful promotional vehicle.

The leaf members 93 and 97, if desired, can be attached to one another to provide essentially two double-thickness leaves in combination with the two single-thickness leaves 95, or they can be allowed to remain as illustrated where the attachment is limited to the two narrow bands 101 at the base thereof so that there are in essence six separate leaves, counting each of the two pairs of juxtaposed leaves. Alternatively, the halves 79, 81 could be shortened to terminate at one of the lines of perforations 99 and thereby eliminate either the leaves 93 or the leaves 97 so as to present only four individual leaves in the final product. When the sheet material item is used as a promotional vehicle, the leaves can be printed as redeemable coupons which are easily detachable through the lines of perforations 99. Thus, the recipient could be attractively presented with six detachable coupons that are ready for removal and use to promote the products or services desired. Moreover, the halves could alternatively be shortened at the ends of the attachment regions 101 to eliminate the leaf members 93 and 97, in which case there would be only the two leaf members 95*a* and *b*, which as previously mentioned, could be die-cut to have different shapes.

Although the invention has been described with regard to what is presently considered to constitute the best mode for fabricating these sheet material items, it should be understood that various changes and modifications as would be obvious to one having the ordinary skill in this art may be made without departing from the scope of the invention which is set forth in the claims appended hereto. For example, although rectangular cover panels are shown and are preferred, one or both of the cover panels could be die-cut to have an irregular shape. Although the two intermediate sheets in the embodiment shown in FIGS. 5 through 7 are described as individual sheets, they could be die-cut from a single sheet joined along a line of weakness that would be aligned with the fold-line 43 which structure would be folded upon itself once along that line before the subpanels 53 and 55 were folded over as shown in FIG. 6. Similarly, although the side panels are preferably of the same width so as to create a parallelogram structure, one of the side panels could be slightly wider than the other to achieve a somewhat different effect.

Figure 15:
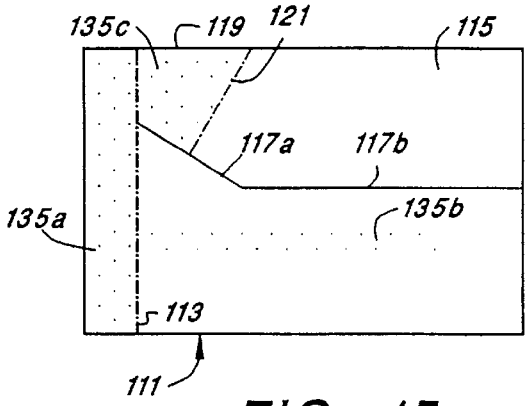
FIGS. 15 and 16 are front views of a rear cover and an intermediate sheet for use to constructing an alternative embodiment to the item shown in FIG. 1 which also embodies various features of the invention.
Figure 16:
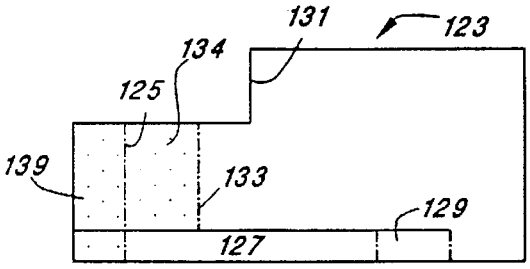

Another such modified sheet material item can be provided by optionally die-cutting the rear cover so that the display panel is carved out of the cover itself, for example in the upper edge region, as shown in FIG. 15. FIG. 15 shows a rear cover 111 having a line of weakness 113 parallel to its left-hand edge to create a false backbone in that region as discussed with respect to FIG. 1. However, die-cut in the rear cover 111 along its upper edge is a display panel 115 which can extend generally from the false backbone along the left-hand edge of the cover and can have any suitable shape. In the illustrated embodiment, it is defined by an oblique slit 117*a* which angles downward from the line of weakness 113 to a horizontal slit 117*b* which extends to the right-hand edge of the sheet. A generally triangular subpanel 119 is formed as a part of the display panel to which it remains hinged thereto along an angled line of weakness 121 which extends from the upper edge to the oblique slit. A facade panel 123, shown in FIG. 16, has a similar vertical line of weakness 125 to define the false backbone and has die-cut along its lower edge a long attachment tab 127 and a right-hand minor side wall panel 129. A rectangular relief 131 is die-cut from the facade panel in the upper left-hand corner thereof so as to permit the desired adhesive bonding discussed hereinafter, and a second line of weakness 133 is provided parallel to the line of weakness 125 which defines the false backbone to provide the opposite left-hand minor side wall panel 134.

Figure 17:
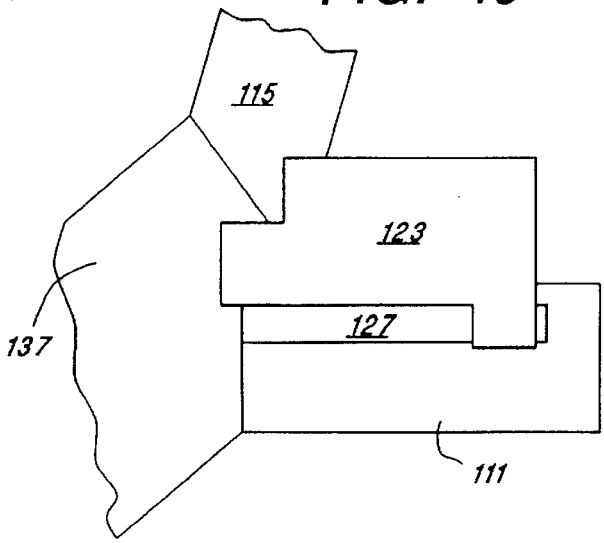
FIG. 17 is a fragmentary perspective view generally similar to FIG. 3 showing the fabricated sheet material item being opened, with the items shown in FIGS. 15 and 16 being depicted in three-dimensional orientation.

In the fabrication, an adhesive pattern 135*a* is applied to the upper surface of the rear panel in the region of the false backbone, and a second generally horizontally extending adhesive pattern 135*b* is provided just below the display panel to attach the elongated tab thereto. A third adhesive pattern 135*c* is provided in the region of the generally triangular subpanel 119 which is hinged to the display panel. The facade panel 123 and a front cover 137 which can be rectangular and merely contain a single line of weakness to define the false backbone are then sequentially superimposed upon the rear cover. The intermediate panel is preferably provided with an adhesive pattern 139 along the false backbone region and on the surface of the side wall 134, or alternatively this adhesive pattern can be provided along the interior surface of the front cover 137. The intermediate panel 123 is located so that the horizontal edge of the relief 131 lies just below the triangular subpanel 119; however, the lower edge could be allowed to bond to the undersurface of the left-hand side wall 134. After all of the adhesive attachments have been made, opening of the sheet material item causes the display panel 115 to rise upward, as shown in FIG. 17, sliding along the interior surface of the facade panel 123 as a result of the interconnection between the generally triangular subpanel 119 and the interior surface of the front cover 137 which along with the panel 134 constitute the left-hand side wall of the box-like structure.

Figure 18:
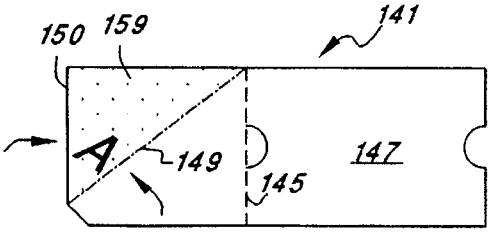
FIGS. 18 and 19 show alternative embodiments of a display panel and a facade panel, similar to those shown in FIG. 1, for use in constructing still another version of a sheet material item embodying various features of the invention.
Figure 19:
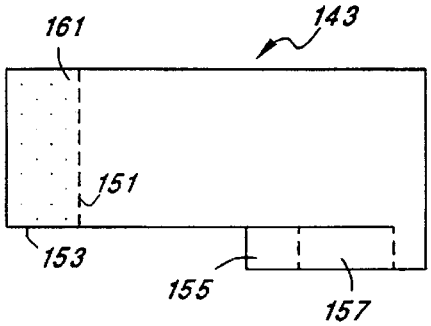
Figure 20:
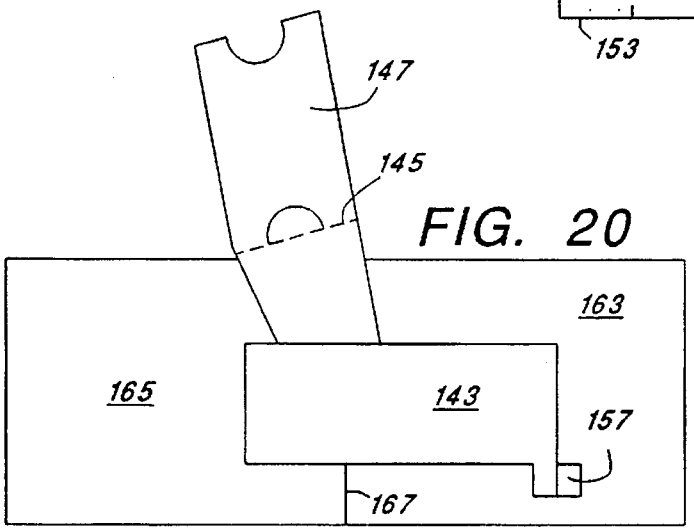
FIG. 20 is a view similar to FIG. 4 showing the sheet material item fabricated from the elements of FIGS. 18 and 19 in its fully opened orientation.

Shown in FIGS. 18 and 19 are further alternative embodiments of a display panel 141 and a facade panel 143. The display panel 141 has a line of perforations 145 creating a detachable coupon 147 at the end of the display panel and includes a line of weakness 149 which is oriented at an angle A of about 55° to the vertical and defines a triangular subpanel 150. The facade panel 143 has a vertical line of weakness 151 which defines the left-hand minor side panel 153, and it has die-cut along its lower edge an attachment tab 155 that is hinged to a minor panel 157 which is hinged in turn to the remainder of the facade panel. The minor side panel 157 constitutes the right-hand side wall of the ultimate box-like structure. The facade panel 143 is superimposed upon the display panel 141 so that an adhesive pattern 159 covering the triangular subpanel creates a short triangular attachment between the rear surface of the left-hand side panel 153 and the bottom of the triangular subpanel 150 but no attachment across the hinge line 151 to the main facade panel. An adhesive pattern 161 is also provided on the upper surface of the left-hand subpanel 153 and either on the rear surface of the attachment tab 155 or in the corresponding location on a rear cover 163. The display panel 141 and the facade panel 143 are then disposed in place atop the interior surface of either the rear cover 163 or a front cover 165 of a two-panel cover member, with the panels 141 and 143 so aligned. The two covers are superimposed by folding along a vertical hinge line 167 to sandwich the display panel and the facade panel therebetween so that the triangular panel 150 and the side panel 153 become attached to the interior surface of the front cover 165. Opening of the front and rear covers 165, 163 to the full open position shown in FIG. 20 causes the display panel 141 to pivot from its partially hidden condition and swing counterclockwise to the orientation shown therein. Because angle A was greater than 45°, the coupon portion 147 at the end of the display panel has swung past a directly vertical orientation as a result of the display panel sliding along the interior surface and the upper edge of the facade panel 143.

As an alternative to the embodiment shown in FIGS. 8–13 which creates a rosette-like three dimensional configuration, the individual halves can be formed as a single piece and simply folded upon each other, after the application of adhesive to the regions 101, to create the superimposed flat intermediate structure, in which case the leaves 93 and 97 would be joined to each other along a fold-line. However, if their separation is desired so that six separate leaves are presented, either a slit or a line of perforations could be formed as a part of the die-cutting operation, so as to lie along the common edges between the pairs of leaf members 93 and 97 colinear with such a fold-line between the triangular subpanels 83. The two halves could also alternatively be formed integrally with the covers, e.g. along the upper edges thereof, as part of an assembly having a false backbone arrangement, and then trimmed to remove the original connecting regions to create a finished product similar to that shown in FIGS. 12–14 having a false backbone.

Other subtle changes that would make the structures more easily fabricated by machine assembly will also be apparent to those skilled in this art and are considered to be equivalents to the structures illustrated. For example, the lines of weakness 29 and 27*b* in FIGS. 1 to 4 might be arranged at complementary angles to the vertical to create a slightly different effect.

Particular features of the invention are emphasized in the claims that follow.

What is claimed is:

1. A sheet material item which comprises front and rear cover panels which are interconnected so as to be hinged together along a straight hinge line, intermediate sheet material disposed between said cover panels and affixed thereto so as to form a tubular structure in combination with said cover panels when said cover panels are opened by pivoting along said straight hinge line, said structure having a major front wall, a pair of minor side walls, and a major rear wall, and a display panel being located in at least partially hidden orientation behind said major front wall, said display panel having a hinged subpanel which is affixed to an interior surface of said structure in the region of one of said side walls so that said display panel moves in a plane generally along one of said major walls which constitute said structure in pivoting from its location at least partially within said structure to a prominent attention-attracting position exterior thereof.

2. A sheet material item according to claim 1 wherein one end portion of said intermediate sheet material is affixed to one said cover panel at a location adjacent said straight hinge line and said intermediate sheet material is attached to said other cover panel which forms said major rear wall of said structure by a minor panel which forms a hinged connection therewith at a location spaced from said straight hinge line and which constitutes one of said minor side walls, and wherein said subpanel is hinged to said display panel along a line at an angle between about 15° and about 70° to said straight hinge line.

3. A sheet material item according to claim 2 wherein said intermediate sheet material includes a major panel which forms said major front wall and at least one side panel hinged thereto which at least partially forms one of said minor side walls.

4. A sheet material item according to claim 3 wherein two of said side panels are located in generally flanking relationship to said major panel and form the interior surfaces of both said side walls.

5. A sheet material item according to claim 4 wherein said subpanel is affixed to one of said pair of flanking side panels of said intermediate sheet material.

6. A sheet material item according to claim 4 wherein said generally flanking side panels are of substantially equal length so that said major front panel is oriented substantially parallel to said major rear wall.

7. A sheet material item according to claim 2 wherein said subpanel is affixed either directly to the interior surface of said front cover panel or indirectly thereto by said one end portion of said intermediate sheet material and wherein said display panel in pivoting to its prominent exterior position moves generally along the interior surface of said major front wall of said structure.

8. A sheet material item according to claim 7 wherein said display panel is die-cut from said rear cover panel.

9. A sheet material item according to claim 1 wherein said intermediate sheet material includes two minor side panels one of which is affixed to the interior surface of one of said front and rear cover panels at a location generally adjacent said straight hinge line, and the other of which minor side panel is affixed to said other cover panel.

10. A sheet material item according to claim 9 wherein said subpanel is affixed to the interior surface of said other minor side panel so that said display panel pivots to its exterior position by sliding generally along the interior surface of said other cover panel.

11. A sheet material item which comprises front and rear cover panels which are interconnected so as to be hinged together along a straight hinge line, and an intermediate sheet material structure sandwiched between said cover panels in generally flat condition when said cover panels are superimposed in closed condition and affixed to said cover panels so as to form a three-dimensional structure when said cover panels are opened by pivoting along said straight hinge line, said intermediate sheet material structure including first and second panels, and said intermediate structure and said cover panels being adhesively interconnected so that, upon opening of said cover panels, said intermediate sheet material structure assumes a three-dimensional orientation with a portion of said first panel moving to a prominent position by sliding along a portion of said second panel.

12. A sheet material item which comprises first and second cover panels which are interconnected so as to be hinged together along a first straight hinge line, intermediate sheet material disposed between said cover panels and affixed thereto so as to form a front facade panel which is oriented generally parallel to said first cover panel when said cover panels are opened by pivoting along said straight hinge line, said front facade panel being hinged along a second hinge line to a minor side wall which is interconnected to said second cover panel, and said front facade panel also being hingedly connected with said first cover panel by a minor panel at a location spaced from said straight hinge line and a display panel being located in at least partially hidden orientation behind said front facade panel, said display panel including a subpanel which is hinged to the remainder of said display panel along a line of weakness oriented at an angle of between about 15° and about 70° with said straight hinge line, said subpanel also being interconnected with said second cover panel so that said display panel moves in a plane generally along one of said front facade panel and said first cover panel in pivoting to a prominent attention-attracting position exterior of its orientation behind said front facade panel.

13. A sheet material item according to claim 12 wherein a first panel at one end portion of said intermediate sheet material which constitutes said minor side wall is affixed to said second cover panel at a location generally adjacent said straight hinge line.

14. A sheet material item according to claim 13 wherein said intermediate sheet material is die-cut to form said front facade panel, a second panel which is affixed to said first cover panel, and said minor connecting panel that is hinged to said second panel and to said facade panel.

15. A sheet material item according to claim 14 wherein said connecting panel is hinged to said facade panel at a location adjacent the end opposite from that at which said first panel is located.

16. A sheet material item according to claim 15 wherein said subpanel is affixed partially to said first panel and partially to said second cover panel so that said display panel in pivoting to its prominent exterior position moves generally along the interior surface and one longitudinal edge of said front facade panel.

17. A sheet material item according to claim 16 wherein said subpanel is generally triangular in shape and is hinged to the remainder of said display panel along a line at an angle of about 55° to said straight hinge line.

18. A sheet material item according to claim 17 wherein said display panel includes a coupon attached by perforations to the remainder of said display panel.

19. A sheet material item according to claim 12 wherein said subpanel is adhesively affixed to said second cover panel.

20. A sheet material item according to claim 12 wherein said display panel is formed from said first cover panel.

* * * * *